US008793914B2

(12) United States Patent
Anderson et al.

(10) Patent No.: US 8,793,914 B2
(45) Date of Patent: Aug. 5, 2014

(54) WEAPON MAGAZINE BOOT

(75) Inventors: Jeffrey D. Anderson, Hampshire, IL (US); Martin J. Nilsen, Hampshire, IL (US); Christopher A. J. Iannello, Rolling Meadows, IL (US)

(73) Assignee: Illinois Tool Works Inc., Glenview, IL (US)

( * ) Notice: Subject to any disclaimer, the term of this patent is extended or adjusted under 35 U.S.C. 154(b) by 130 days.

(21) Appl. No.: 13/497,656

(22) PCT Filed: Sep. 16, 2010

(86) PCT No.: PCT/US2010/049079

§ 371 (c)(1),
(2), (4) Date: Mar. 22, 2012

(87) PCT Pub. No.: WO2011/037812

PCT Pub. Date: Mar. 31, 2011

(65) Prior Publication Data

US 2012/0174452 A1 Jul. 12, 2012

Related U.S. Application Data

(60) Provisional application No. 61/245,074, filed on Sep. 23, 2009.

(51) Int. Cl.

| | |
|---|---|
| ***F41A 9/61*** | (2006.01) |
| ***F41C 23/16*** | (2006.01) |
| ***F41H 3/00*** | (2006.01) |
| ***F41A 9/65*** | (2006.01) |

(52) U.S. Cl.
CPC . *F41A 9/65* (2013.01); *F41C 23/16* (2013.01); *F41H 3/00* (2013.01)
USPC ..... 42/49.01; 42/50; 42/90

(58) Field of Classification Search
USPC ..... 42/49.01, 50, 7, 90
See application file for complete search history.

(56) References Cited

U.S. PATENT DOCUMENTS

| | | | |
|---|---|---|---|
| 5,293,708 | A | 3/1994 | Strayer et al. |
| 5,526,600 | A | 6/1996 | Chesnut et al. |
| 5,566,487 | A | 10/1996 | Vaid et al. |
| 6,212,815 | B1 | 4/2001 | Fitzpatrick |
| 6,634,131 | B1 | 10/2003 | Fitzpatrick |
| 6,928,764 | B2 | 8/2005 | Freed |
| 6,986,221 | B2 | 1/2006 | Mullis |
| 7,191,556 | B2 | 3/2007 | Pikielny |
| 7,497,043 | B2 | 3/2009 | Clifton, Jr. et al. |

FOREIGN PATENT DOCUMENTS

WO 0063632 A2 10/2000

OTHER PUBLICATIONS

ISR for PCT/US2010/049079 dated Dec. 17, 2010.

*Primary Examiner* — Michelle R Clement
(74) *Attorney, Agent, or Firm* — Mark W. Croll; Paul F. Donovan

(57) ABSTRACT

A weapon magazine boot for covering the exposed portion of a weapon magazine provides improved gripping features and reduced detection when observed through night vision or lowlight observation systems.

18 Claims, 4 Drawing Sheets

WEAPON MAGAZINE BOOT

CROSS-REFERENCE TO RELATED APPLICATIONS

The present application is national phase of PCT/US2010/049079 filed Sep. 16, 2010, and claims the benefits of U.S. Provisional Application Ser. No. 61/245,074 filed Sep. 23, 2009.

FIELD OF THE INVENTION

The present invention relates generally to weapons magazines and to night vision camouflage. More specifically, the invention provides a protective sheath or boot covering the exposed portion of a weapon magazine when the magazine is installed in the magazine well of a weapon or when being stored in a magazine pouch or carrier.

BACKGROUND OF THE INVENTION

Weapons magazines are known to be made of smooth surfaced metal that may be coated to provide some visual camouflage and protection against environmental elements. However, when observed with night vision or lowlight systems, the exposed metal portion of a weapon magazine can be highly detectable, even with existing, known coatings are used. Detection of a soldier's equipment can be used to reveal the location of the soldier, even if the soldier is well-camouflaged personally.

Further, the relatively smooth outer surface of a weapon magazine can be difficult to grip and hold securely when removing the magazine from a carrying pouch, when loading the magazine into a weapon, when unloading the magazine from the weapon, or when otherwise handling the magazine. Under the adverse conditions of combat, including adverse environmental conditions and personal stress, mishandling a weapon magazine can occur. If a soldier is wearing gloves, handling can be even more difficult.

SUMMARY OF THE INVENTION

The present invention provides a boot, sheath or sleeve covering the portion of a weapon magazine that remains exposed in a weapon. The boot can be configured to include a bottom covering the exposed end of the weapon magazine.

In one aspect of a form thereof, a weapon magazine boot is provided with a sleeve configured to surround at least a portion of a weapon magazine, the sleeve provided in a shape, composition and configuration to be retained on the weapon magazine during use of the weapon magazine in a weapon.

In another aspect of another form, a weapon magazine boot is provided with a sleeve including connected sidewalls configured to surround an exposed portion of a weapon magazine during use of the weapon magazine in a weapon, and a base connected to the side walls at an end of the side walls. The sleeve provides an exterior surface of improved grip ability relative to a weapon magazine on which it is installed.

In a further aspect of a further form, a weapon magazine boot is provided with a molded silicone sleeve including connected sidewalls configured to surround an exposed portion of a weapon magazine during use of the weapon magazine in a weapon, and a base integrally connected to the side walls at an end of the side walls. The sleeve includes a textured area and/or a finger ridge for improved grip ability relative to a weapon magazine on which it is installed.

Other features and advantages of the invention will become apparent to those skilled in the art upon review of the following detailed description, claims and drawings in which like numerals are used to designate like features.

Figure 1:
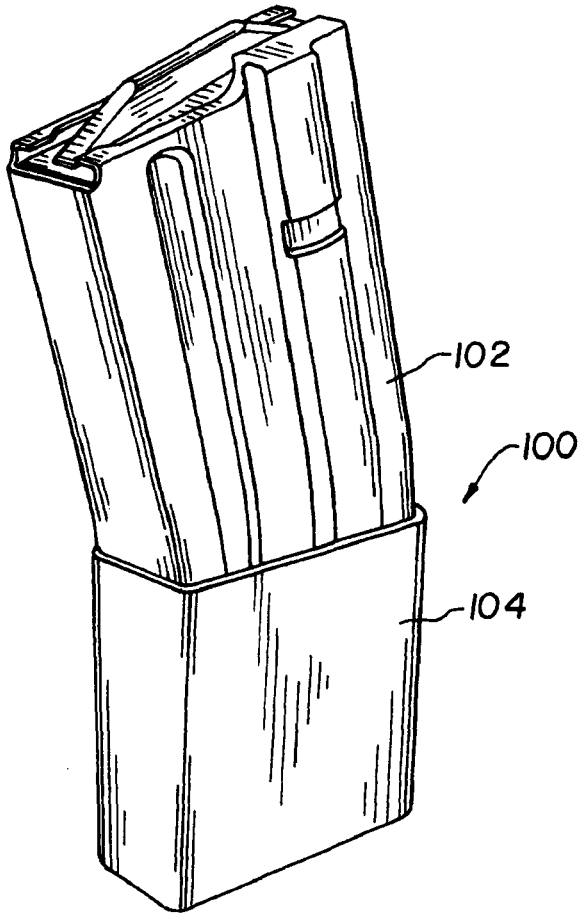
FIG. 1 is a perspective view of a magazine boot installed on a weapon magazine.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
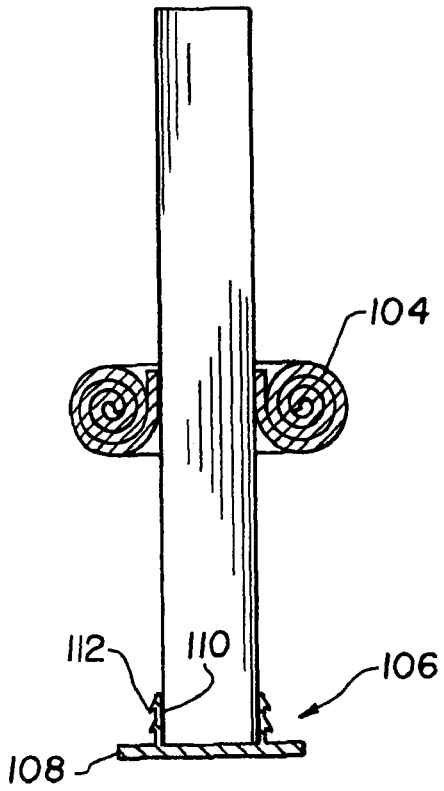
FIG. 2 is a cross-sectional view of a variation of the magazine boot shown in FIG. 1, showing a stage during installation of the boot on a weapon magazine.
Figure 3:
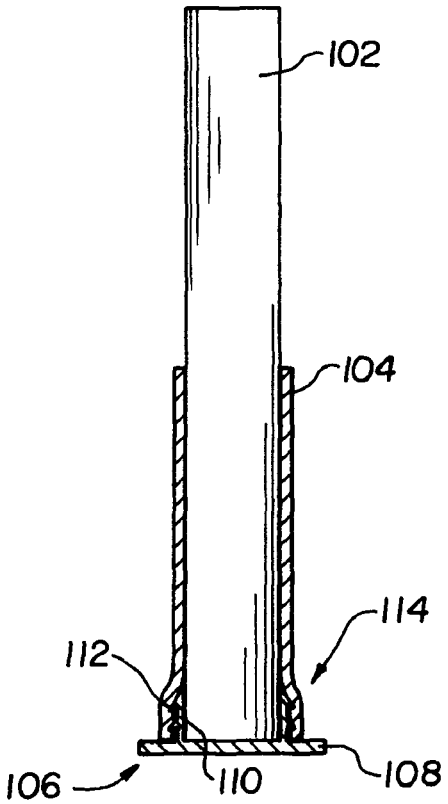
FIG. 3 is a cross-sectional view similar to that of FIG. 3, but illustrating the weapon magazine boot fully installed on the magazine.

Referring now more particularly to the drawings and to FIGS. 1-3 in particular, in a basic form thereof, a weapon magazine boot 100 is shown installed on a weapon magazine 102. Boot 100 includes a sleeve or sheath 104 surrounding an end portion of magazine 102, generally that portion that remains exposed even when the magazine is loaded into a weapon (not shown). Sleeve 104 is generally closely fitted to magazine 102 so as to remain in place on magazine 102 even as magazine 102 is loaded into a weapon, removed from a weapon, placed in or removed from carriers or pouches, or otherwise handled and manipulated. Magazine boots can be made out of various rubbers and plastics, and may be made of elastomeric material so as to stretch over and fit snugly around weapon magazines. Sleeve 104 of magazine boot 100 is extruded rubber that can be rolled onto magazine 102. Sleeve 104 provides improved grip on magazine 102 to reduce the likelihood of hand slippage as magazine 102 with boot 100 thereon is handled and manipulated. If made of thin-walled elastic material, sleeve 104 can be installed on magazine 102 even when magazine 102 is loaded in a weapon by rolling sleeve 104 onto the exposed portion of magazine 102. The open bottom of sleeve 104 allows access to the end of magazine 102 for cleaning or other purposes.

Magazine boot 100 can also include an end cap 106 used together with sleeve 104 (FIGS. 2 and 3). End cap 106 has a base 108 and an upstanding wall 110 having protrusions or barbs 112 extending outwardly thereof, and can be made of molded rubber or plastic, for example. End cap 106 fits closely on an end of weapon magazine 102 and protects the bottom of magazine 102 from debris while also concealing the bottom of magazine 102 from detection when viewed under night vision or low light systems. Sleeve 104 surrounds magazine 102 and can be installed from a rolled up condition as shown in FIG. 2 to an unrolled condition overlying wall 110 of end cap 106, as shown in FIG. 3. End cap 106 is secured on magazine 102 and under sleeve 104 by barbs 112 engaging the inner surface of sleeve 104. With sleeve 104 overlying protrusions or barbs 112, a bulge area 114 is formed at the end of the magazine boot, thus further facilitating gripping and minimizing slippage when magazine 102 with boot 100 thereon is grasped, handled and manipulated. Base 108 can project outwardly of bulge area 114 to even further facilitate grasping and handling. End cap 106 can be removed from magazine 102 for cleaning magazine 102 or other purposes by rolling sleeve 104 off and away from wall 110. End cap 102 can then be slid off the end of magazine 102 even without removing sleeve 104 from magazine 102.

Figure 4:
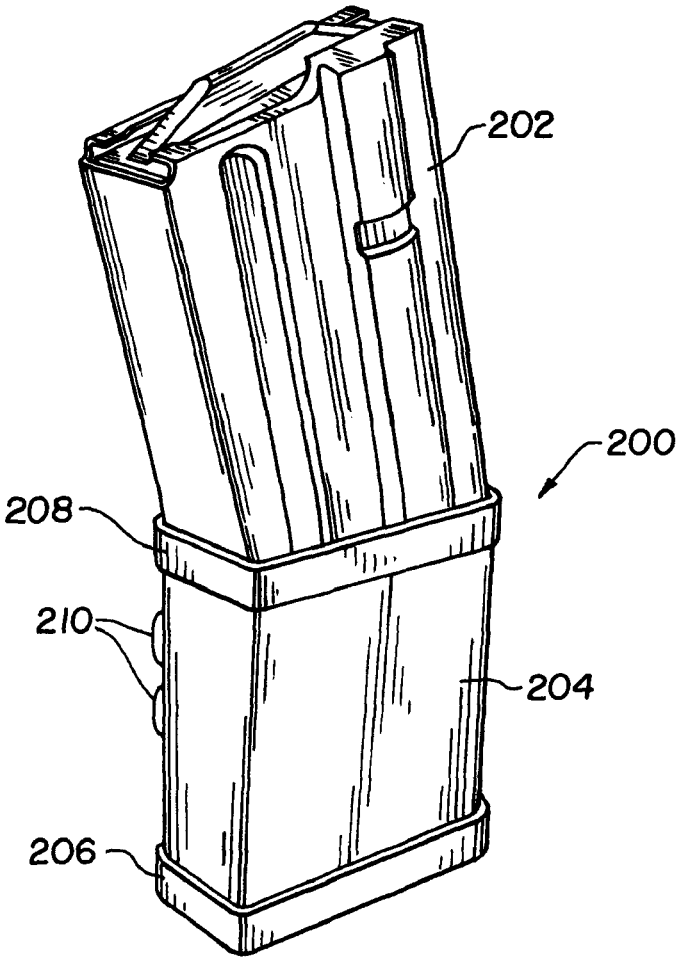
FIG. 4 is a perspective view of another embodiment of a magazine boot installed on a weapon magazine.

FIG. 4 shows another embodiment of a weapon magazine boot 200 installed on a weapon magazine 202. Magazine boot 200 includes a sleeve or sheath 204 with a thickened lower band 206 which can overlie an end edge portion of sleeve 204 or, in a preferred structure therefor, is formed integrally with sleeve 204 by injection molding. Further, a thickened upper band 208 is provided at the opposite edge of sleeve 204 from lower band 206. Upper band 208 can overlie a terminal edge portion of sleeve 206 or can be integrally formed with sleeve 204 as lower band 206 by injection molding as a monolithic structure including sleeve 204 and bands 206, 208. Upper band 208 at the top of boot 200 provides a sealing function in relation to the magazine well of a weapon, to inhibit dirt, debris and other contaminants from entering the magazine well. Lower and upper bands 206, 208 provide discontinuity in the outer surface of sleeve 204 to improve gripping and reduce slippage. Further, however, sleeve 204 can be provided with finger ridges 210 in one or several areas of sleeve 204 to further improve gripping and reduce slippage. When made of elastic material, boot 200 can be pulled over the exposed end of weapon magazine 202 even when magazine 202 is loaded in a weapon. An open bottom on boot 200 allows access to the end of magazine 202 for cleaning. Covering the major exposed surfaces of magazine 202 reduces the susceptibility of magazine 202 to detection from night vision and low-light viewing systems.

Figure 5:
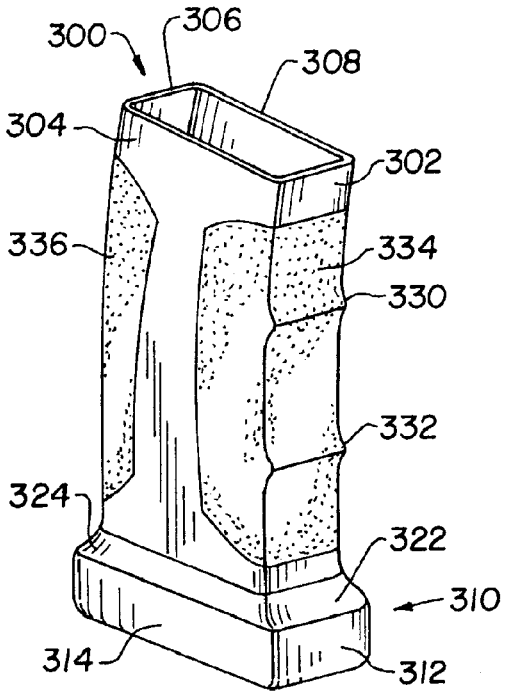
FIG. 5 is a perspective view of still another embodiment of a weapon magazine boot.
Figure 6:
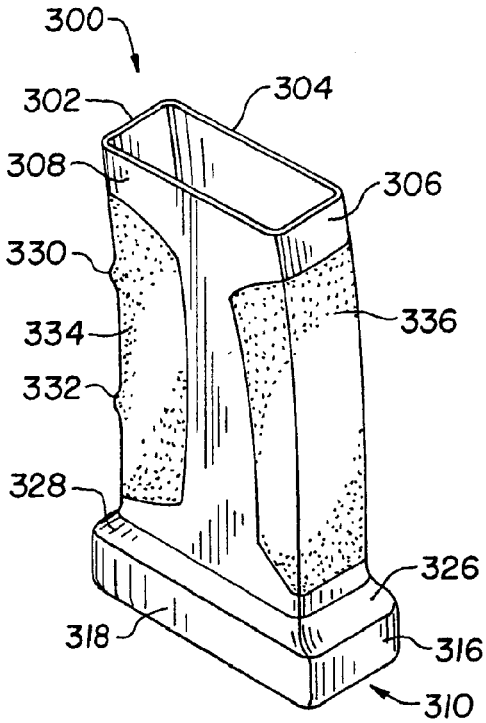
FIG. 6 is a perspective view of the magazine boot shown in FIG. 5, but shown from a different angle.
Figure 7:
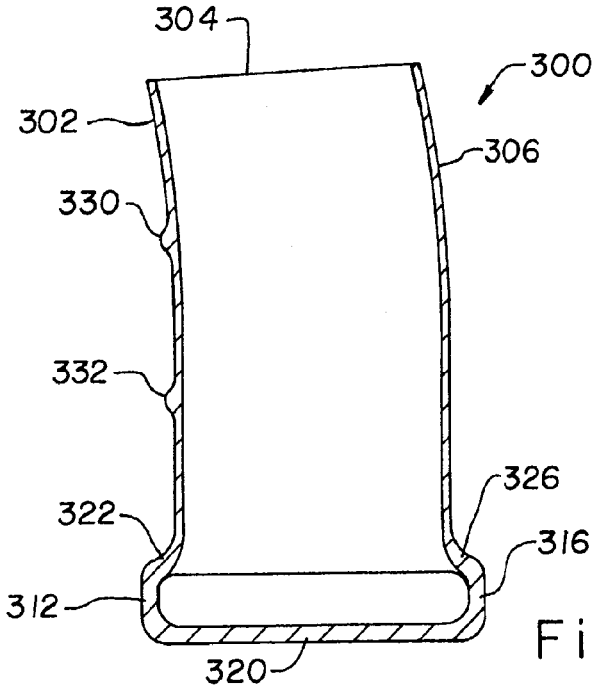
FIG. 7 is a cross-sectional view of the magazine boot shown in FIGS. 5 and 6.

A magazine boot can be formed by injection molding in a contoured shape to fit a particular weapon magazine. Magazine boot 300 shown in FIGS. 5-7 is slightly arched or curved to slide onto a curved weapon magazine. Magazine boot 300 can be made of silicone of approximately 30 durometer by injection molding processes. However, other materials and materials including silicone of higher or lower durometer also can be used. Magazine boot 300 includes a sleeve including shaped side walls 302, 304, 306, 308 configured to slide on to and surround the lower, exposed portion of a weapon magazine. It should be understood that the particular configuration, proportions and curvature shown are merely exemplary, and to fit a particular weapon magazine other shapes, proportions and curvatures can be used. Side walls 302, 304, 306, 308 are integrally formed with a base 310 including thickened sides 312, 314, 316, 318 and a bottom 320. Sloped, tapered transitions 322, 324, 326, 328 join side walls 302, 304, 306, 308 to thickened sides 312, 314, 316, 318, respectively. Finger ridges 330, 332 can be provided in some or all side walls 302, 304, 306, 308. In the exemplary embodiment shown, finger ridges 330, 332 are provided only in side wall 302. Further, roughened, textured or raised particle reduced slip areas 334, 336 can be provided. In the exemplary embodiment shown, textured areas 334, 336 are provided over substantial areas of walls 302, 306, respectively and overlapping onto adjacent walls 304, 308. It should be understood that more or fewer such textured areas can be provided, and textured areas can be provided in other shapes, arrangements and configurations. Textured areas having raised, pebble-like projections similar to 40 grit abrasive paper have been found to work acceptably for improving grip and reducing slippage.

Figure 8:
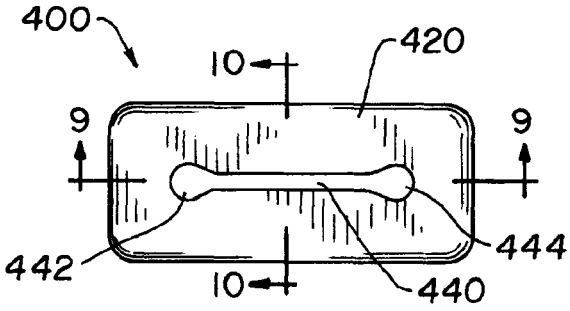
FIG. 8 is a an end view of a modified form of the magazine boot shown in FIGS. 5, 6 and 7.
Figure 9:
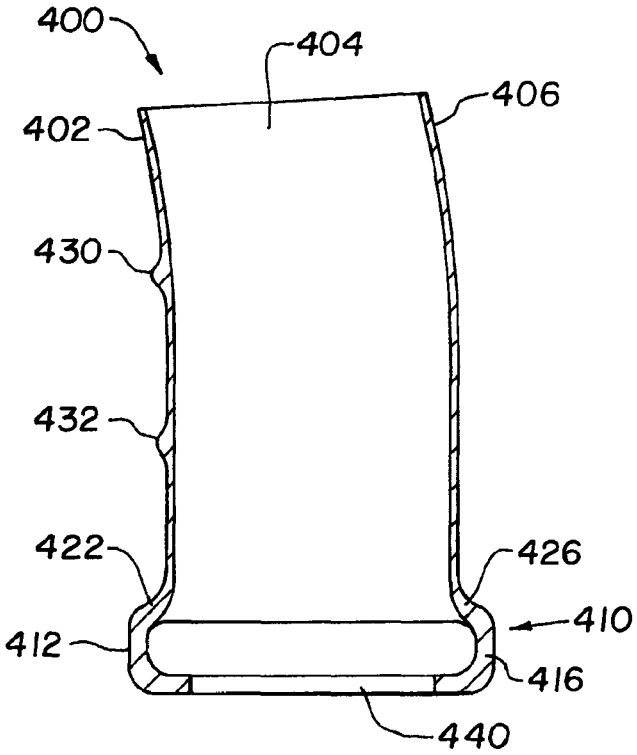
FIG. 9 is a cross-sectional view of the magazine boot shown in FIG. 8, taken along line 9-9 of FIG. 8.
Figure 10:
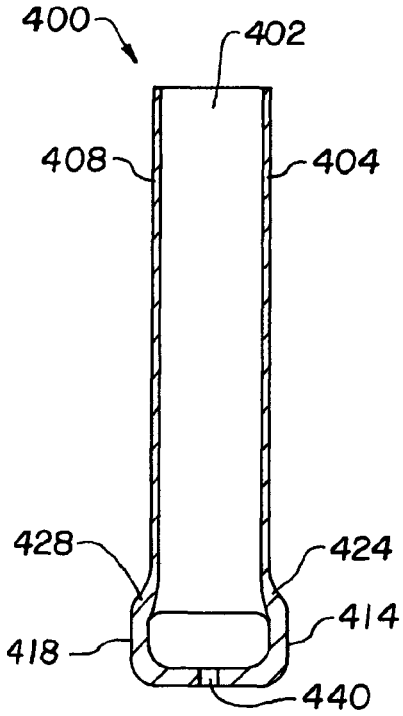
FIG. 10 is a cross-sectional view of the magazine boot shown in FIG. 8, taken along line 10-10 of FIG. 8.

FIGS. 8, 9 and 10 illustrate a magazine boot 400 similar to magazine boot 300. Accordingly, magazine 400 includes a sleeve having shaped side walls 402, 404, 406, 408; a base 410 including thickened sides 412, 414, 416, 418 and a bottom 420 similar to side walls 302, 304, 306, 308; base 310; thickened sides 312, 314, 316, 318 and bottom 320 described previously. Sloped, tapered transitions 422, 424, 426, 428 are provided between sidewalls 402, 404, 406, 408 and thickened sides 412, 414, 416, 418 similar to the aforedescribed sloped, tapered transitions 322, 324, 326, 328. Magazine boot 400 further includes finger ridges 430, 432 and can include textured areas similar to the finger ridges 330, 332 and textured areas 334, 336 described previously for magazine boot 300. Bottom 420 is provided with an elongated hole or opening 440 in the way of an elongated slot which may include enlarged open areas 442, 444 at the opposite ends thereof to permit access to the bottom of a weapon magazine on which boot 400 is installed without having to remove magazine boot 400 from the weapon magazine.

Still other embodiments of the present invention are contemplated, including a relatively rigid clamshell or locking boot that can be made of hinged portions using a mechanical hinge or a living hinge so as to be opened and closed to capture an end portion of a weapon magazine therein. Accordingly, the boot of such embodiments can be made of relatively rigid material and/or of combinations of pliable and rigid materials to achieve the desired locking and engaging configurations.

The weapon magazine boots 100, 200, 300, 400 disclosed herein are less susceptible to detection by night vision or lowlight vision equipment, including reducing infrared reflection when viewed with night vision goggles. However, those skilled in the art will understand that the materials for and the outer surface configurations of the weapon magazine boot can be selected to achieve the desired characteristics of camouflage, detection prevention and grip-ability. It is further contemplated however that the weapon magazine boot will be removable from the magazine for needed use, servicing and maintenance of the magazine.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A weapon magazine boot, comprising:

a sleeve configured to surround at least a portion of a weapon magazine;

said sleeve provided in a size, shape, composition and configuration to be retained on the weapon magazine during use of the weapon magazine in a weapon, said sleeve including connected sidewalls, wherein all of the sidewalls have the same consistent cross-sectional thickness from top to bottom except from any areas of finger ridges provided in any of said sidewalls, said sleeve further having a smooth, flat continuous inner surface from said top to said bottom prior to retention on the weapon magazine.

2. The weapon magazine boot of claim 1, said sleeve comprising elastic, stretchable material able to be rolled onto and off of a weapon magazine.

3. The weapon magazine boot of claim 1, including an end cap having a base and a wall extending from said base, said sleeve overlapping said wall.

4. The weapon magazine boot of claim 3, said wall having outwardly projecting barbs engaging said sleeve.

5. The weapon magazine boot of claim 1, said sleeve having a thickened band at the lower edge thereof.

6. The weapon magazine boot of claim 1, said sleeve having a thickened band at the upper edge thereof.

7. The weapon magazine boot of claim 1 said sleeve having a thickened lower band at the lower edge thereof and a thickened upper band at the upper edge thereof.

8. The weapon magazine boot of claim 7, said sleeve and said bands being integrally formed as a monolithic structure.

9. The weapon magazine boot of claim 1, said sleeve including textured areas rougher than adjacent areas.

10. The weapon magazine boot of claim 9, including a base at an end of said sleeve.

11. The weapon magazine boot of claim 10, said base having a bottom with a hole therethrough.

12. The weapon magazine boot of claim 11, said hole being elongated with enlarged open areas at ends thereof.

13. A weapon magazine boot, comprising:

a sleeve including connected sidewalls having the same consistent cross-sectional thickness over height except from any areas of finger ridges provided in any of said sidewalls, and configured to surround an exposed portion of a weapon magazine during use of the weapon magazine in a weapon;

a base connected to each of said side walls at an end of each of said side walls; and said sleeve providing an exterior surface of improved grip relative to a weapon magazine on which it is installed.

14. The weapon magazine boot of claim 13, including at least one textured area on the outer surface of said sleeve.

15. The weapon magazine boot of claim 13, said base including a bottom and a hole through said bottom.

16. The weapon magazine boot of claim 15, said hole being elongated with enlarged open areas at ends thereof.

17. The weapon magazine boot of claim 13, said base having thickened the sides; and said weapon magazine boot further including curved tapered transitions between said side walls and said thickened sides.

18. A weapon magazine boot, comprising:

a molded silicone sleeve including connected sidewalls of a generally consistent cross-sectional thickness and configured to surround an exposed portion of a weapon magazine during use of the weapon magazine in a weapon;

a base integrally connected to said side walls at an end of said side walls; and said sleeve having at least two finger ridges on one side wall thereof, said finger ridges providing an exterior surface of improved grip relative to a weapon magazine on which it is installed.

* * * * *